US005190385A

United States Patent [19]

Taguchi et al.

[11] Patent Number: 5,190,385

[45] Date of Patent: Mar. 2, 1993

[54] INK RIBBON REGENERATING DEVICE

[75] Inventors: Tetuo Taguchi, Kawaguchi; Hiroshi Wada, Misato; Keiichi Emura, Koshigaya; Yutaka Shinohara, Kounosu; Yoshihiro Wada, Yashio; Isao Onuki, Misato; Kazunori Suzuki, Kasukabe; Kazuo Sakai, Satte, all of Japan

[73] Assignee: Pentel Kabushiki Kaisha, Japan

[21] Appl. No.: 734,273

[22] Filed: Jun. 22, 1991

[30] Foreign Application Priority Data

| | | | |
|---|---|---|---|
| Jul. 30, 1990 | [JP] | Japan | 2-81003[U] |
| Aug. 30, 1990 | [JP] | Japan | 2-90810[U] |
| Sep. 29, 1990 | [JP] | Japan | 2-103083[U] |
| Jan. 30, 1991 | [JP] | Japan | 3-8650[U] |

[51] Int. Cl.[5] ..... B41J 31/14

[52] U.S. Cl. ..... 400/200; 400/197

[58] Field of Search ..... 400/200, 197, 196, 207, 400/208, 202, 202.1, 202.2, 202.3, 202.4; 118/235, 246

[56] References Cited

U.S. PATENT DOCUMENTS

| | | | |
|---|---|---|---|
| 926,764 | 7/1909 | Phillips | 400/200 |
| 3,693,547 | 9/1972 | Morgan | 101/155 |
| 3,955,385 | 5/1976 | Becker | 118/246 |
| 4,408,910 | 10/1983 | Masao | 400/207 |
| 4,948,275 | 8/1990 | Kuhn et al. | 400/200 |
| 5,007,370 | 4/1991 | Dannatt | 118/246 |
| 5,040,458 | 8/1991 | Jiruse et al. | 101/216 |

FOREIGN PATENT DOCUMENTS

| | | | |
|---|---|---|---|
| 56-21884 | 2/1981 | Japan | 400/207 |

*Primary Examiner*—Edgar S. Burr
*Assistant Examiner*—Anthony H. Nguyen
*Attorney, Agent, or Firm*—Bruce L. Adams; Van C. Wilks

[57] ABSTRACT

A device for regenerating with ink an ink ribbon which is set in an ink ribbon cassette and has consumed ink contained therein is disclosed. The device includes a housing having an upper surface for mounting the cassette thereon; a guide pin disposed on the upper surface for slidably guiding the ribbon drawn out of the cassette; a guide roller inserted into and movable along an elongated slot formed in the upper surface for guiding the ribbon under tension in cooperation with the guide pin; a rotatable ink pad disposed on the upper surface to contact with the ribbon being guided by the guide pin and the guide roller for transfer ink on the ribbon; and driving means for moving the ribbon in the cassette. In operation, the cassette is removably held on the upper surface, and the guide roller is releasably locked at its play position with a solenoid to thereby make the ribbon contacted with the ink pad.

19 Claims, 9 Drawing Sheets

INK RIBBON REGENERATING DEVICE

FIELD OF THE INVENTION

The present invention relates to an ink ribbon regenerating device and particularly to a device for distributing ink on an ink ribbon which is set in an ink ribbon cassette, when the ink contained therein has been consumed.

BACKGROUND OF THE INVENTION

In the past, when the ink contained in an ink ribbon set in an ink ribbon cassette, e.g., for a dot printer has consumed, the cassette has usually been discarded. However, it is wasteful to discard such an ink ribbon cassette as a whole because its casing and ribbon tape themselves can stand long use.

For this reason, the various kinds of ink ribbon regenerating devices have been provided and disclosed, for example, in Japanese Laid-open Utility Model applications Nos. 55-33715/1980, 57-16364/1982, 62-15957/1987 and 62-180545/1987.

The device disclosed in the above application No. 55-33715/1980 includes a base, a first reel for winding an ink ribbon to be regenerated, a first shaft disposed on the base for rotatably supporting the first reel, a second reel for winding the ink ribbon which has been regenerated, a second shaft driven to rotate and supporting the second reel, a driving means for driving the second shaft to rotate, an ink pad disposed between the first and second reels for transferring ink onto the ink ribbon being moved from the first reel to the second reel, and an ink feeder for supplying ink to the ink pad. The device is used for regenerating an ink ribbon wound in a reel which is directly set in a dot printer. However, in such a device, it takes time before a sufficient amount of ink is transferred from the ink feeder to the ink pad connected to the feeder, and also it is not easy to adjust the amount of ink in the ink pad in a suitable range.

The device disclosed in the above application No. 57-1634/1982 includes a supporting member for rotatably supporting a first spool for winding an ink ribbon to be regenerated, a supporting and winding means for supporting a second spool for winding the regenerated ink ribbon and for forcedly rotating the second spool, a roller unit provided between the supporting member and the supporting and winding means and having a plurality of rollers which are overlapped to contact with each other through their dead loads, a press roller disposed to be overlapped with the upper one of said plurality of rollers for pressing on the upper roller the ink ribbon being moved under tension between the supporting member and the supporting and winding means, and an ink reservoir for supplying ink to the lower one of said plurality of rollers. However, in such a device, when the ink ribbon to be regenerated has been in a cassette, it is necessary for the operation thereof to draw said ribbon out of the cassette and rewind said ribbon around the fist spool, and also in a case where the ribbon is of the endless type, the ribbon can not be regenerated over its total length.

The device disclosed in the above application No. 62-15957/1987 includes a rotary shaft projected out of the front surface of a casing and rotated by a motor in the casing through a reduction gear mechanism, a guide pin disposed on the front surface of the casing and capable of being removably inserted into a cartridge ribbon case to thereby fix the ribbon case on the front surface when the ribbon case is operatively engaged with the rotary shaft through a hole of the ribbon case for receiving the rotary shaft, a ribbon guiding means disposed on the front surface between the guide pin and the rotary shaft for slidably guiding the ribbon, and an ink feeder for supplying ink to the ribbon guiding means. However, in such a device, it is not easy to suitably control the amount of ink to be transferred onto the ribbon and the time necessary for distributing ink on the ribbon and also to suitably set the ribbon case on the device.

The device disclosed in the above application No. 62-15987/1987 includes a vertical base plate movable up and down and urged upward by a spring, a cassette mounting member disposed on the base plate for holding on the base plate a ribbon cassette having an ink ribbon wound by a pair of spools arranged in the cassette and exposed out of the cassette between the pair of spools, a ribbon winding mechanism for driving one of the spools to rotate to thereby draw out the used ink ribbon wound around the other spool and wind the regenerated ribbon around said one of the spools, an inking roller provided below the lower end of the base plate for distributing ink on the used ribbon, and a press roller disposed on the lower end of the base plate to abut the back side of the used ribbon which is out of the cassette for forcedly contacting the used ribbon with the inking roller when the base plate is moved down and locked in position. However, in such a device, it is necessary for the operation thereof to move the base plate downward by hand and lock the base plate on a frame for slidably supporting the plate. Also, the device is restricted to be used only for a special ribbon cassette which can be fittingly interposed between the upper and lower supporting pieces, fixed on the base plate, of the cassette mounting member and operatively engaged with the ribbon winding mechanism.

SUMMARY OF THE INVENTION

It is an object of the present invention to provide a device for regenerating with ink an ink ribbon set in an ink ribbon cassette, in which the disadvantages of the aforementioned prior art devices are eliminated to make the device convenient.

According to the present invention, there is provided an ink ribbon regenerating device comprising a housing having an upper surface thereof which is used for mounting an ink ribbon cassette thereon and having a motor within the housing; power transmitting means provided in the housing and operatively connected to the motor and releasably engaged with an ink ribbon moving mechanism disposed in the ink ribbon cassette for transmitting the power of rotation of the motor to the ink ribbon driving mechanism to thereby move an ink ribbon of the cassette when the cassette is mounted in position on the housing; holding means provided on the upper surface of the housing for removably holding down one of the opposite edge portions of the ink ribbon cassette to thereby lock the cassette in position on the upper surface; a guide pin fixedly provided on the upper surface of the housing for slidably guiding the ink ribbon drawn out of the ink ribbon cassette; a guide roller inserted into and movable along an elongated slot formed in the upper surface of the housing for guiding the ink ribbon drawn out of the ink ribbon cassette while applying a tension to the ink ribbon in cooperation with the guide pin; a rotatable ink pad provided on the upper surface of the housing to forcedly contact with the ink ribbon which is drawn out of the ink ribbon cassette and tensed with both the guide pin and the guide roller for distributing ink contained in the ink pad onto the ink ribbon; and a solenoid having a plunger actuated thereby and provided in the housing for releasably locking a central shaft of the guide roller with the plunger at one of the opposite ends of the elongated slot.

In preferred embodiments of the present invention, the device further includes a spring connected at an end thereof with said guide roller for restoring the guide roller to the other one of the opposite ends of the elongated slot when the solenoid has been operated to release the guide roller from said end of the slot, and at least one hollow formed in the upper surface of the housing for detachably receiving therein a projection formed on the outside of one of the upper and lower surfaces of the ink ribbon cassette to thereby mount the cassette in position on the upper surface. In addition, preferably the device includes a timer for selectively setting a period of operation of the motor and controlling means for controlling the solenoid to retract the plunger in cooperation with the timer so that the guide roller is released from its locked state at said end of the elongated slot when ink from the ink pad has again been distributed on the ink ribbon.

In at least preferred arrangements, in use ink ribbon to be regenerated is drawn out of the ink ribbon cassette and caught on the guide pin, with the guide roller in its non-play position in the elongated slot, and then the cassette is secured on the upper surface of the housing with the holding means, wherein the holding means are constructed and disposed to be able to hold the cassette irrespective of its shape and size. Next, the guide roller is moved along the elongated slot and releasably locked at its play position with the solenoid so that the ink ribbon is tensed and forcedly contacted with the ink pad, and subsequently the ink ribbon is moved by the motor through the power transmitting means. Thereby the ink ribbon is regenerated with ink in the ink pad.

Preferably the inventive device is usable for various kinds of ink ribbon cassettes by providing beforehand driving shafts of different shapes or sizes which are replaceably set in the power transmitting means and each of which is releasably engageable with the ink ribbon moving mechanism in the corresponding ink ribbon cassette.

BRIEF DESCRIPTION OF THE DRAWINGS

The accompanying drawings illustrate embodiments of an ink ribbon regenerating device according to the present invention, wherein.

DESCRIPTION OF THE PREFERRED EMBODIMENTS

Referring to FIGS. 1 to 4, an embodiment of the ink ribbon regenerating device according to the present invention will be described.

Figure 1:
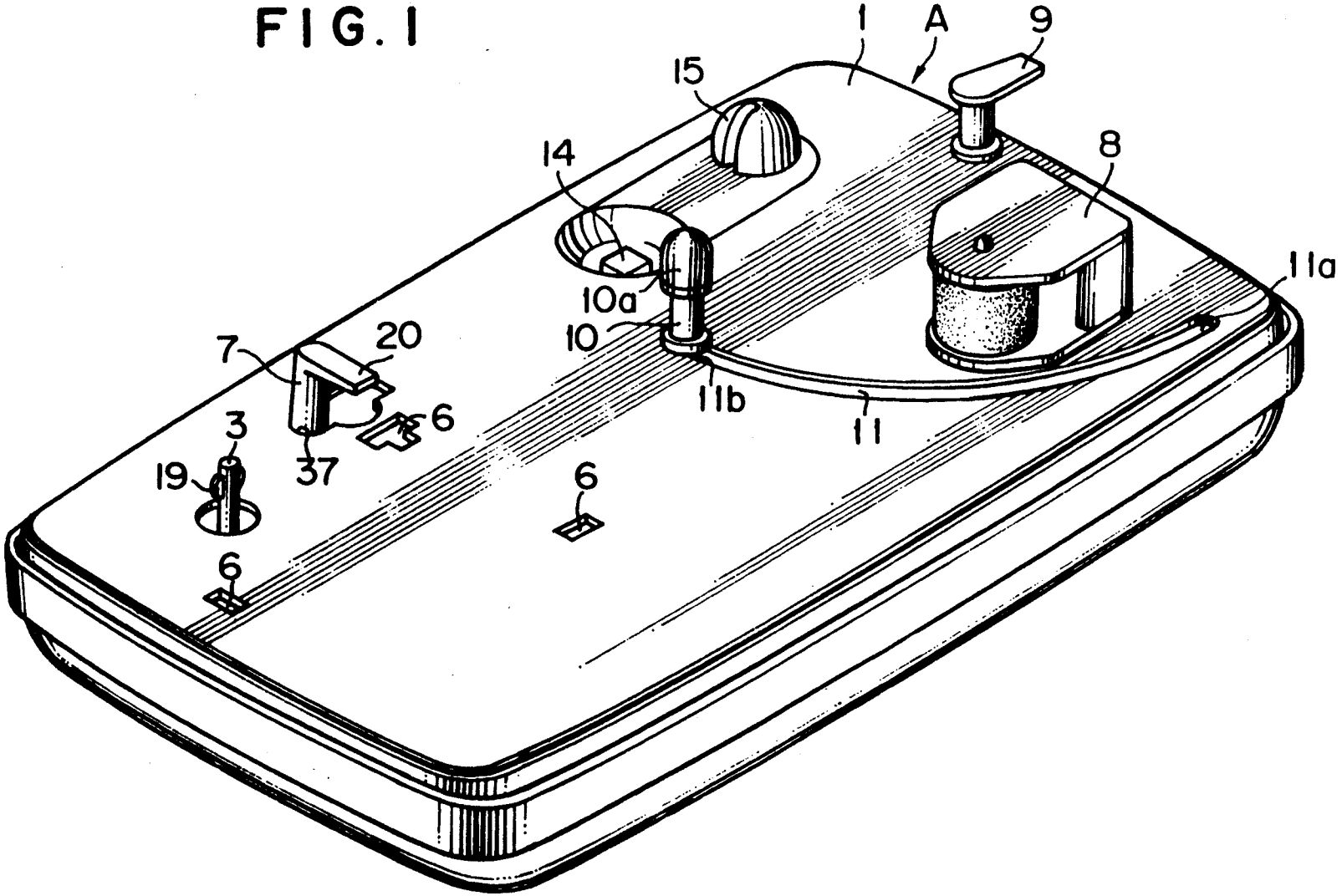
FIG. 1 is a perspective view of an embodiment of the device according to the present invention.
Figure 2:
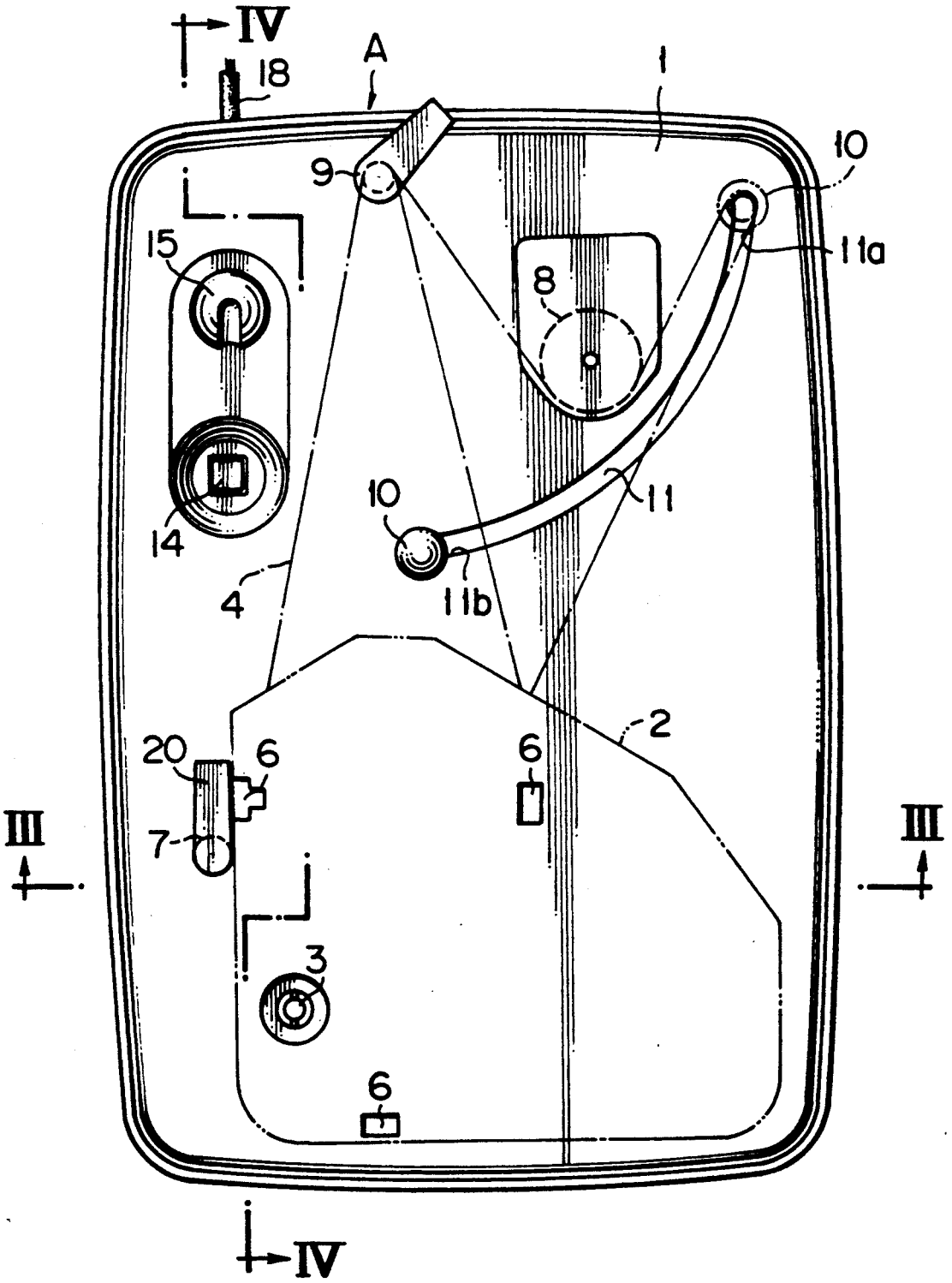
FIG. 2 is a plan view of the device of FIG. 1, wherein the device mounts an ink ribbon cassette and the cassette is shown in broken lines.

Referring to FIGS. 1 and 2, the device has a housing A having an upper surface 1. On the front half portion of the upper surface 1 are disposed a guide pin 9 for guiding an ink ribbon 4 drawn out of an ink ribbon cassette 2 mounted on the upper surface 1, a rotatable ink pad 8 absorbing ink for distributing the ink on the ink ribbon 4, a switch 14 electrically connected to a motor 5 (see FIG. 4) disposed within the housing A and a timer 15 for selectively setting a period of operation of the motor 5. An elongated slot 11 of the shape in a circular arc the center of which is at the guide pin 9 is formed in the upper surface 1 to have opposite ends 11*a* and 11*b* thereof which are positioned, respectively, near the front edge of and the center of the upper surface 1. A guide roller 10 is slidably inserted into the elongated slot 11 to be able to move along the slot 11 between the opposite ends 11*a* and 11*b* of the slot. The guide roller 10 has a knob 10*a* attached to the top end thereof for moving the guide roller by hand and a center axis 10*b* (see FIGS. 3 and 4) extending below the upper surface 1 of the housing A. In the left side portion of the rear half portion of the upper surface 1 of the housing A are provided a rod 7 which is rotatable and movable up and down and has a horizontal protrusion 20 secured to the the top end of the rod for holding down the ink ribbon cassette 2 on the upper surface 1 when the cassette is mounted on the upper surface 1 and a rotatable shaft 3 having plate-like protrusions 19 secured to and around the shaft for releasably engaging with an ink ribbon moving mechanism (not shown in the drawings) provided in the cassette 2. Also, a plurality of hollows 6 are formed in the rear half portion of the upper surface 1 of the housing A so that according to the kind or shape of the ink ribbon cassette 2 one of the hollows 6 can detachably receive a projection (not shown in the drawings) formed on the outside of one of the upper and lower surfaces of the ink ribbon cassette 2 to thereby mount the cassette 2 in position on the upper surface 1.

Figure 3:
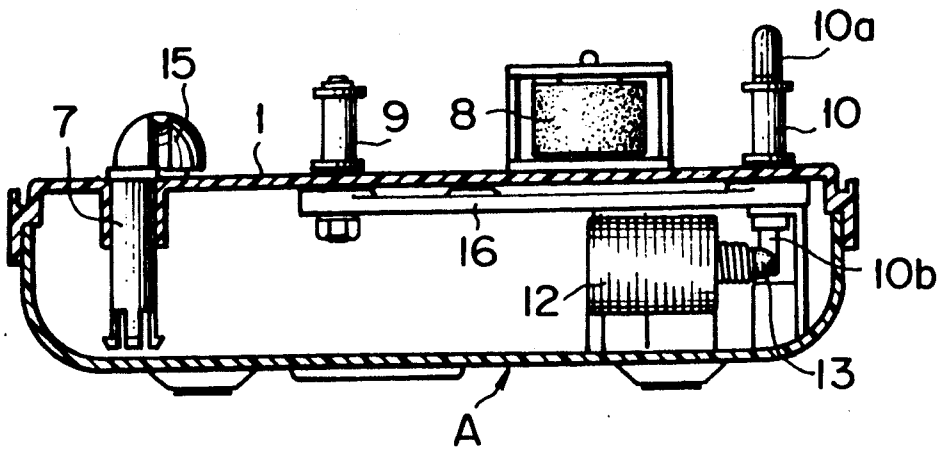
FIGS. 3 and 4 are sectional views taken along lines III—III and IV—IV of FIG. 2, respectively.
Figure 4:
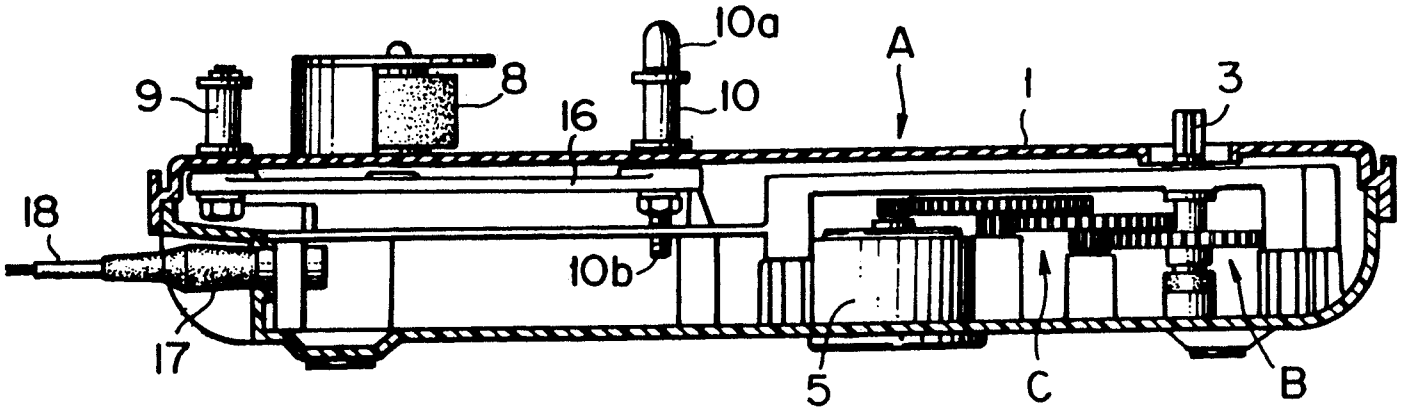

Referring to FIGS. 3 and 4, within the housing A are provided the motor 5; power transmitting means B for transmitting the power of rotation of the motor 5 to the ink ribbon moving mechanism in the ink ribbon cassette 2 to thereby move the ink ribbon 4; a rotation transmitting mechanism C disposed between the motor 5 and the power transmitting means B for transmitting the rotation of the motor 5 to the power transmitting means B; a solenoid 12 having a plunger 13 for releasably locking the guide roller 10 with the plunger 13 at the end 11*a* of the elongated slot 11; and an arm 16 having an end thereof pivotably connected with a shaft of the guide pin 9 and the other end connected with the shaft 10*b* of the guide roller 10 to rotatably support the guide roller. Further, in the housing A, a spring (not shown in the drawings) connected at an end thereof to the guide roller 10 is provided for restoring the guide roller 10 from the end 11*a* to the end 11*b* of the elongated slot 11 when the operation of the device is stopped. Also, a socket 17 electrically connected to the switch 14 is disposed in a side surface of the housing A. The reference numeral 18 denotes a lead wire connected to a power source (not shown in the drawings).

Figure 5:
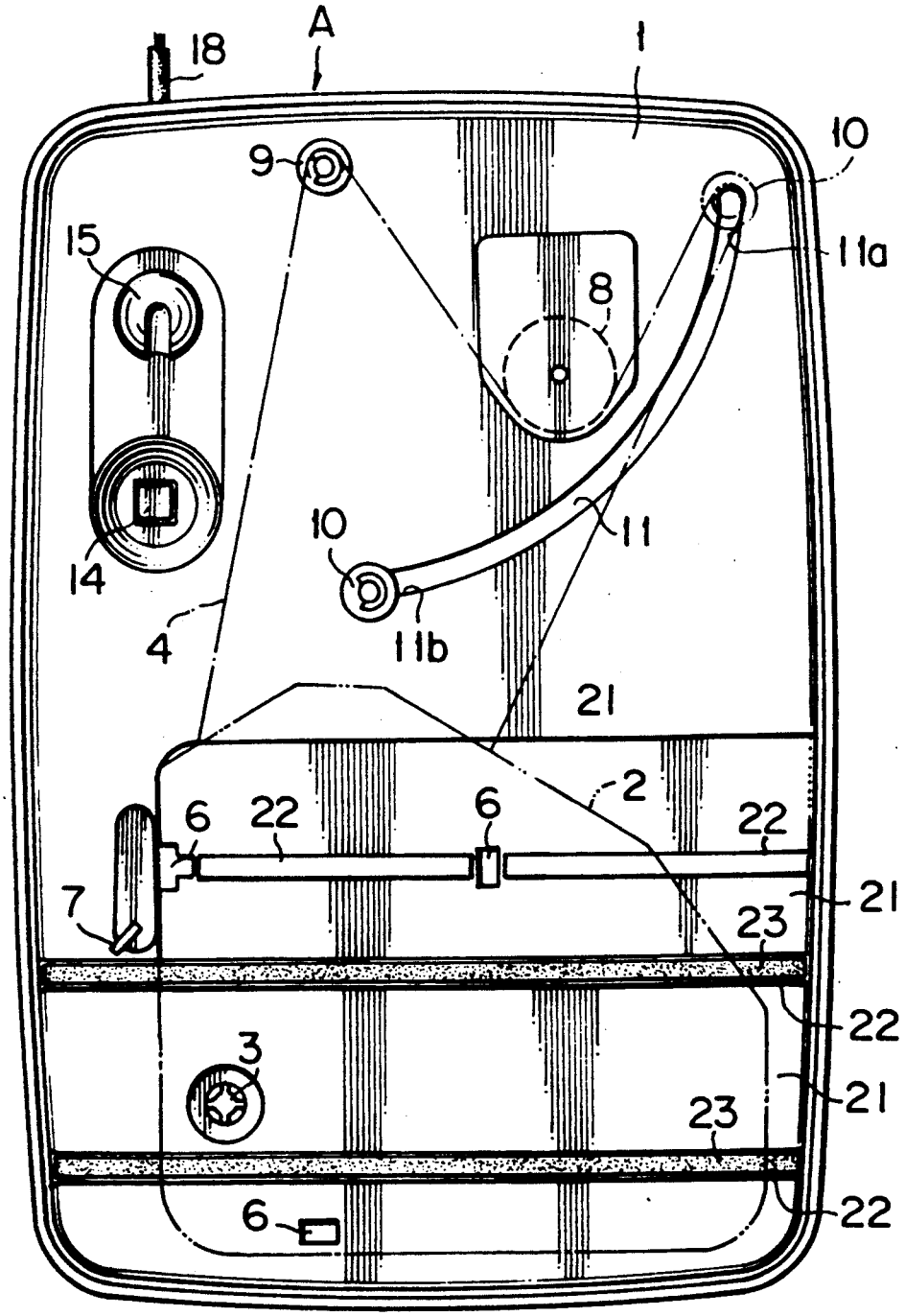
FIG. 5 is a plan view of another embodiment of the device according to the present invention.

FIG. 5 shows another embodiment of the ink ribbon regenerating device according to the present invention. As shown in FIG. 5, the upper surface 1 of the housing A is formed to have an evenly recessed portion 21, and a plurality of elongated horizontal protrusions 22 are formed on the recessed portion 21 with intervals therebetween to mount the ink ribbon cassette 2 thereon. The elongated upper surfaces of the protrusions 22 are covered with an elastic material 23 such as gum. This embodiment is very effective to prevent any slippage of the ink ribbon cassette 2 from a desired set position of the cassette.

Referring to FIGS. 6 to 17, embodiments of the power transmitting means, the holding means and the ink pad according to the present invention will be described.

Figure 6:
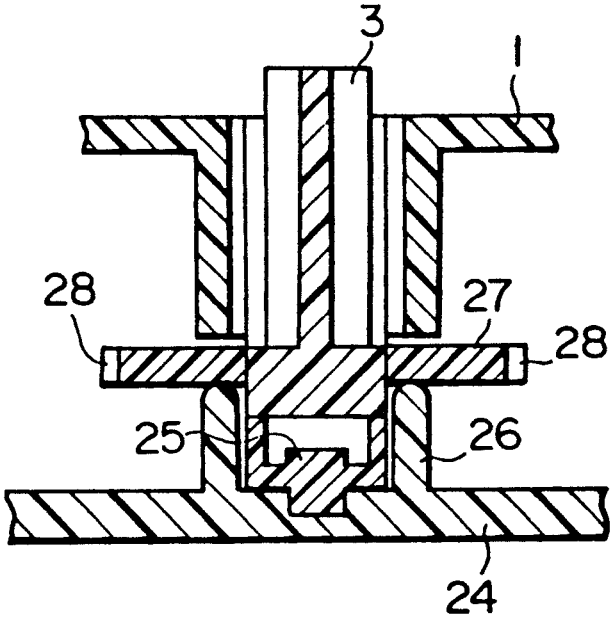
FIG. 6 is a vertical sectional view of the power transmitting means in the device of FIG. 1.
Figure 7:
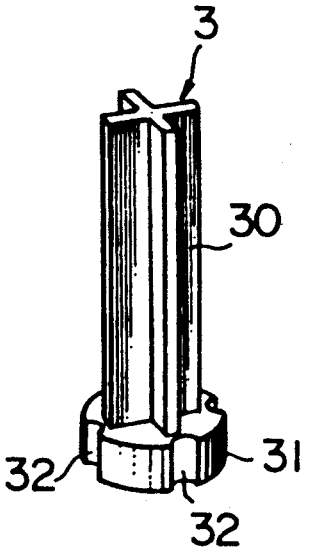
FIGS. 7 and 8 are perspective views of different embodiments of a shaft provided in the power transmitting means of FIG. 6.
Figure 8:
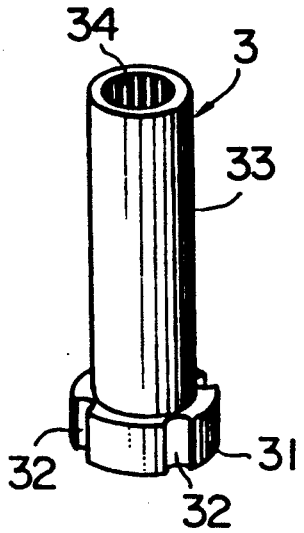

FIG. 6 shows an embodiment of the power transmitting means B, and FIGS. 7 and 8 show different embodiments of the shaft 3 of the power transmitting means.

Referring to FIGS. 6 to 8, a vertical rotator 25 is disposed on the inside of a lower surface 24 of the housing A to be coaxially slidably inserted into a hollow cylinder 26 protruding upwards from the lower surface 24. A horizontal circular flange 27 having a diameter larger than the outer diameter of the hollow cylinder 26 is coaxially secured onto the top end of the rotator 25 with a gap between the flange 27 and the top end of the cylinder 26. The circular flange 27 has gear teeth 28 formed along the periphery of the flange for meshing with a gear (not shown) in the rotation transmitting mechanism C. The aforementioned shaft 3 is inserted into a hole formed in the upper surface 1 of the housing A and removably coaxially connected with the circular flange 27. As shown in FIG. 7, the shaft 3 has a main portion constructed of a pair of vertical plates 30 crossed with each other at the central axis of the shaft and a lower end portion constituted of a horizontal flange 31 having a plurality of grooves 32 formed along the periphery of the flange. The flange 31 is removably engaged with a recessed portion which is formed in a central portion of the upper surface of the flange 27 to have a shape similar to that of the flange 31. Also, as shown in FIG. 8, the shaft 3 is modified to be a hollow cylinder 33 having serrations 34 therein instead of the crossed plates 30 in FIG. 7. In this case, the hollow cylinder 33 is useful for removably receiving and engaging with a finger-screw which is projected from one of the upper and lower surfaces of the ink ribbon cassette 2 and used for manually winding the ink ribbon 4 in the cassette.

FIGS. 9 to 13 show the various embodiments of the rod 7 for holding the ink ribbon cassette 2 on the upper surface 1 of the housing A.

Figure 9:
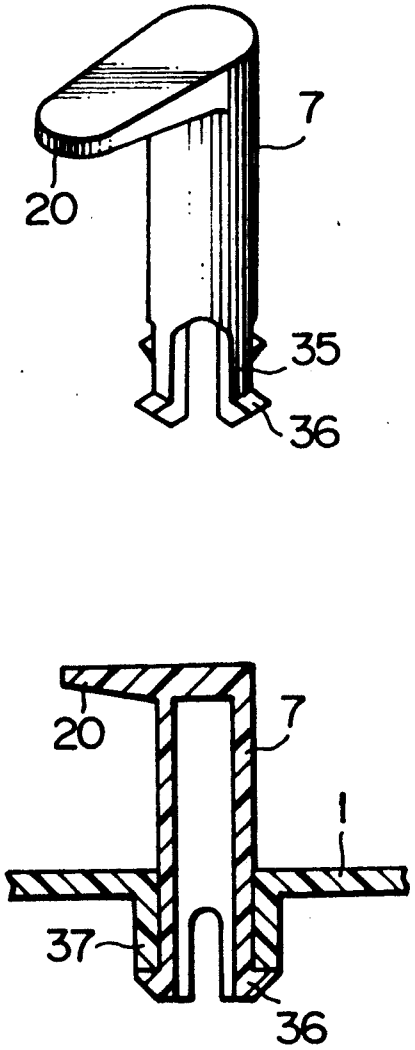

In FIG. 9, the rod 7 is formed into a hollow cylinder and has a lower portion divided into a plurality of vertical strips 35 spaced apart from each other, and each of the lower ends of the strips 35 has a protrusion 36 projecting outwardly and having a lower surface inclined inwardly and downwardly. The rod 7 can be inserted into a cylindrical hole 37 formed in the upper surface 1 by forcedly sliding down the protrusions 36 on the inner surface of the hole and the rod 7 is rotatably locked in the hole by engaging an upper surface of the protrusion 36 with the lower end of the hole 37.

Figure 10:
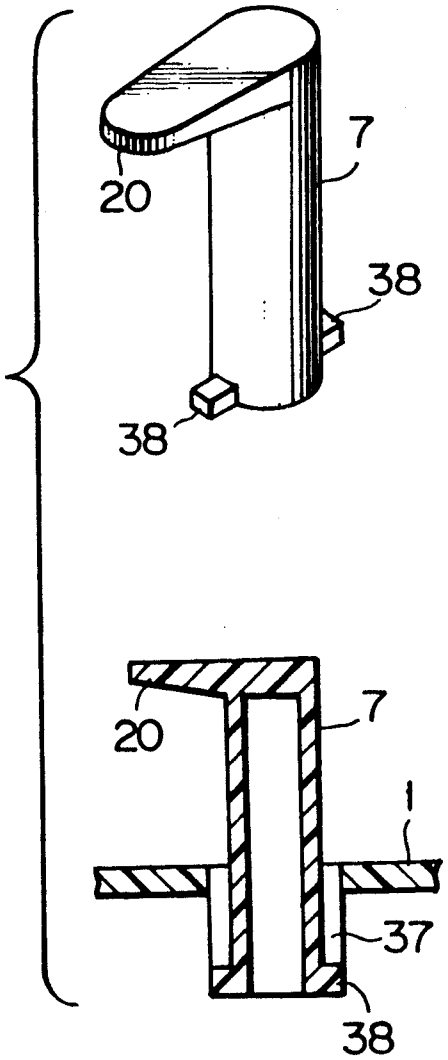
FIGS. 9 to 13 are the respective perspective and sectional views of different embodiments of the holding means in the device of FIG. 1.

In FIG. 10, the hollow rod 7 has a pair of protrusions 38 at the lower end thereof, and the cylindrical hole 37 is provided with a pair of vertical grooves formed in the inner surface of the hole 37 to be able to slidably receive the pair of protrusions 38. The rod 7 can be inserted into the cylindrical hole 37 by sliding down the pair of protrusions 38 in the pair of grooves and locked in the hole 37 by rotating the inserted rod 7 after the protrusions 38 have been moved down beyond the lower ends of the grooves.

Figure 11:
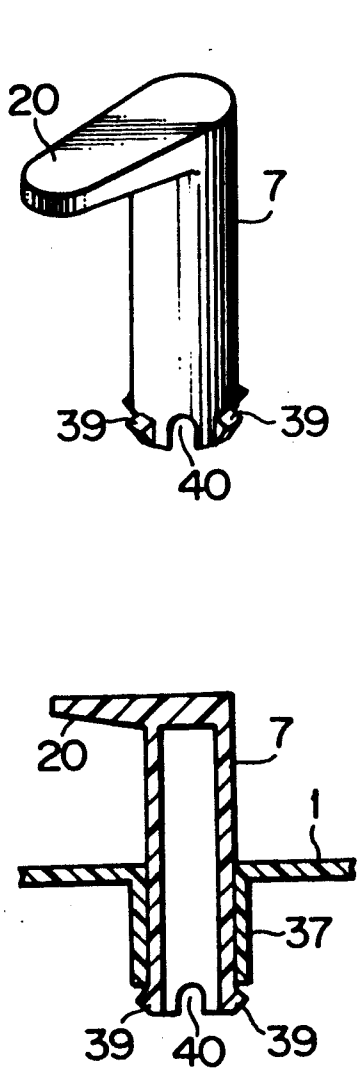

In FIG. 11, the hollow rod 7 has at the lower end thereof a plurality of notched portions 40 opening downward and a plurality of small protrusions 39 formed between each pair of notched portions adjacent to each other. Each of the protrusions 39 is projected outward and has an upper surface inclined outwardly and downward and a lower surface inclined outwardly and upwardly, wherein the upper and lower surfaces intersect to form an edge. The hollow rod 7 can be inserted into and drawn out of the cylindrical hole 37, respectively, by pushing the protrusions 39 in an upper end opening of the hole 37 and by forcedly lifting up the inserted rod 7 so as to push the protrusions 39 in a lower end opening of the hole 37.

Figure 12:
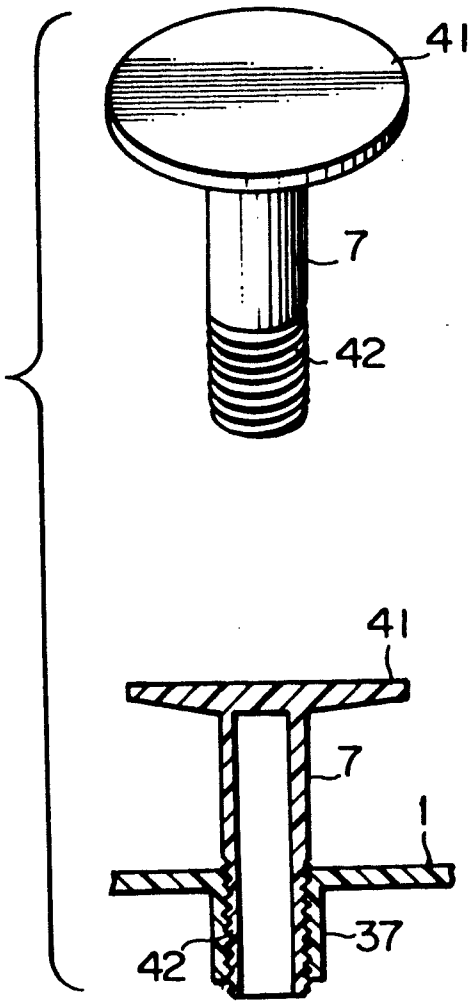

In FIG. 12, the hollow rod 7 has a disc-like flange 41 coaxially secured to the top end of the rod 7, instead of the rectangular protrusion 20 in FIGS. 9 to 11, and has a lower portion formed into an external thread 42. Corresponding to such shape of the rod 7, the inner surface of the cylindrical hole 37 is formed into an internal thread capable of engaging with the threaded lower portion of the rod 7.

Figure 13:
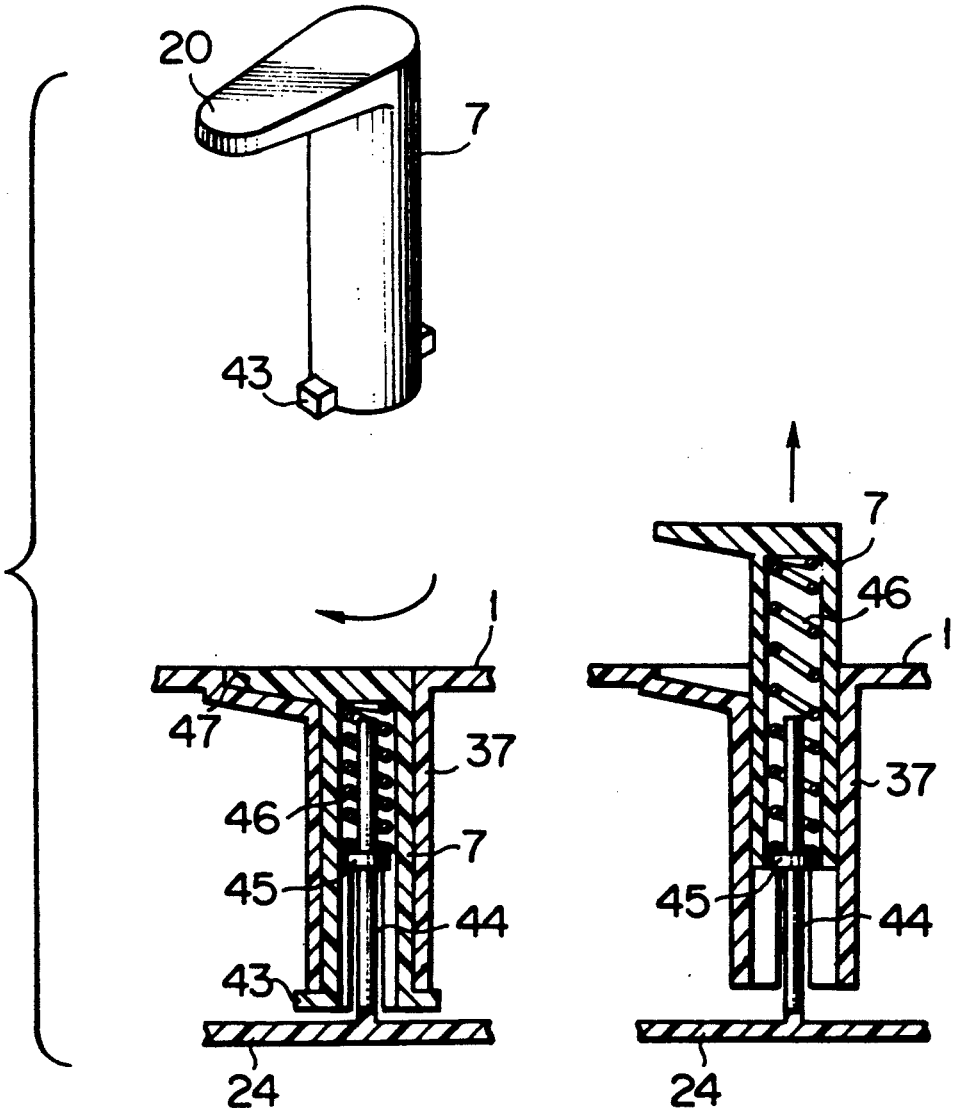

In FIG. 13, the hollow rod 7 has the rectangular protrusion 20 at the top end thereof and a pair of small horizontal protrusions 43 projected from the lower end of the rod. When the hollow rod 7 is inserted into the cylindrical hole 37 by sliding down the protrusions 43 in a pair of vertical grooves formed in the inner surface of the hole 37, the rod 7 receives therein a supporting rod 44 secured at an end thereof to the lower surface 24 of the housing A and extending vertically from the lower surface 24 and also a spring 46 supported at a lower end thereof on a flange 45 formed around a middle portion of the supporting rod 44 and extending upward so as to push the rod 7 upward. In this state, the rod 7 is locked in the cylindrical hole 37 with the spring 46 under compression by engaging the protrusions 43 with the lower end of the hole 37. In this embodiment, the cylindrical hole 37 is constructed to effect such functions that the protrusions 43 can be released from engagement with the lower end of the hole 37 when the rod 7 is rotated to some extent and then the protrusions 43 can be locked again at a predetermined position between the upper and lower ends of the hole 37 when the rod 7 is lifted up by the spring 46. Also, a semicircularly recessed portion 47 is formed in the upper surface 1 to be able to pivotably receive the protrusion 20 therein.

Next, in order to evenly and sufficiently distribute ink on the ink ribbon 4 over the total length of the ribbon 4, it is important to select the material and shape of the ink pad 8. It has been found to be preferable, as a result of a lot of experiments, that the ink pad 8 is composed of a polyvinylformal foam or a polyurethane foam and has the shape of a column-like body. Further, it has been found to be highly preferably that the above foams contain micropores the average diameter of which is in a range of 200 to 400 μm and have a porosity not less than 85% by volume and that the above column-like body has a plurality of concave portions formed along the outer circumference of the body.

FIGS. 14 to 17 show the different embodiments of the ink pad 8, wherein the same reference numerals denote the identical or similar portions of the ink pad 8.

Figure 14:
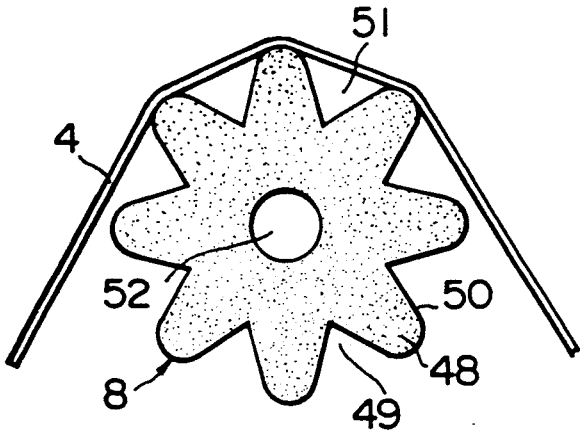
FIGS. 14 to 17 are transverse sectional views of different embodiments of an ink pad in the device of FIG. 1.

In FIG. 14, the ink pad 8 has a peripheral surface 50 with eight projecting portions 48 and eight concave portions 49 and has a central hole 52 for slidably receiving therein a central shaft of the ink pad 8. As shown in the drawing, three projecting portions 48 of the ink pad 8 are contacted with the ink ribbon 4 at the same time, and a space 51 is formed between the ink ribbon 4 and each of the concave portions 49. In this embodiment, compared with a case in which the ink ribbon 4 is contacted with an ink pad formed into a column without any concave portion, the ink pad 8 more strongly abuts the ink ribbon 4 to thereby more easily transfer ink to the ribbon 4 and nevertheless the consumption of ink contained in the ink pad 8 tends to be kept more constant over the total length of the ribbon 4. Although ink is transferred to only the portions of the ribbon 4 contacted with the projecting portions 48, the transferred ink easily diffuses to the other portions not contacted with the projections 48 of the ribbon 4 and accordingly the transferred ink will have been uniformly distributed on the ribbon 4 within a short time.

Figure 15:
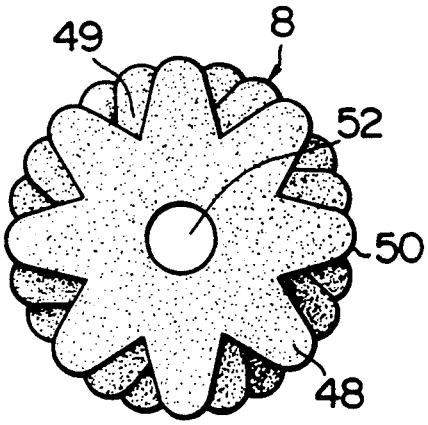

In FIG. 15, the ink pad 8 is shaped to have a profile formed by overlapping with each other a plurality of sections which are similar to the section shown in FIG. 14 and out of phase with each other.

Figure 16:
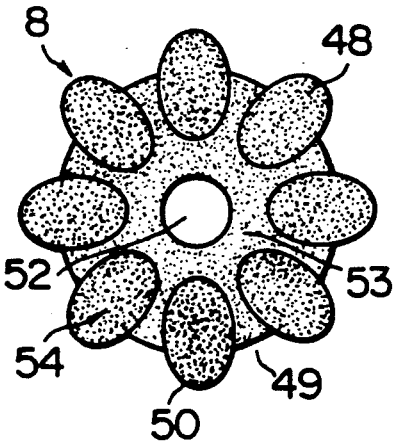

In FIG. 16, the ink pad 8 is constructed of a cylindrical member 53 and eight elliptic cylindrical members 54 radially partially embedded into the cylindrical member 53 to form eight projecting portions 48. In this case, the members 53 and 54 can be composed of different kinds of ink absorbers.

Figure 17:
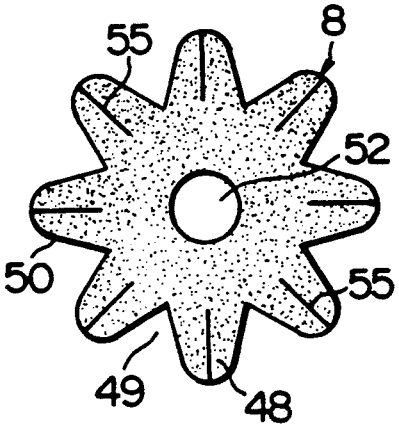

In FIG. 17, the ink pad 8 is similar in shape to that in FIG. 14 and further each of its projecting portions 48 is radially divided to form a slit 55. In this case, the slits 55 are very effective not only to rapidly supply ink contained in the middle or central portion of the pad 8 to the outer ends of the projecting portions 48 but also to enlarge a contact area between the ink ribbon 4 and each of the projecting portions 48.

Referring again to FIGS. 1 to 4, an operation of the device will be described.

First, the guide roller 10 is placed at the end **11*b* of the elongated slot 11. After a portion of the ink ribbon 4 exposed out of the ink ribbon cassette 2 has been caught on the guide pin 9, the cassette 2 is moved rearwards to draw the ribbon 4 out of the cassette 2. Then the cassette 2 is mounted on the upper surface 1 with the shaft 3 inserted into the cassette 2 through a hole formed in the back surface of the cassette 2 and communicated with the aforesaid ink ribbon moving mechanism in the cassette, and then held in position on the upper surface 1 by lifting up and rotating the rod 7 and engaging the protrusion 20 of the rod with the upper surface of the cassette 2. Next, the guide roller 10 is moved in and along the slot 11 by pushing the knob 10*a*, and the guide roller 10 is locked at the end 11*a* of the slot with the plunger 13 of the solenoid 12. The ink ribbon 4 is caught and tensed by the guide roller 10 during the movement of the roller 10 and then forcedly contacted with the ink pad 8 when the roller 10 is locked at the end 11*a* of the slot 11**.

Next, after the guide roller 10 has been locked in its play position, the motor 5 is driven to move the ink ribbon 4 lengthwise by means of the shaft 3 inserted in the ink ribbon cassette 2. The ink pad 8 is forcedly rotated by the movement of the ink ribbon 4 and transfers ink onto the ribbon 4. The period of operation of the motor 5 can be set with the timer 15 so as to correspond with the total length of the ink ribbon 4. Just immediately before the motor 5 is stopped, the solenoid 12 is actuated to restore the plunger 13. Thereby the guide roller 10 is returned by the aforementioned spring to its non-play position at the end **11*b* of the elongated slot 11**.

What is claimed is:

1. A device for regenerating an ink ribbon of an ink ribbon cassette, comprising:

a housing having an upper surface for mounting thereon an ink ribbon cassette having an ink ribbon and an ink ribbon moving mechanism operative when driven for moving the ink ribbon;

a motor disposed in the housing for producing a rotary output;

power transmitting means disposed in the housing and connected to the motor and releasably engaged with the ink ribbon moving mechanism in the ink ribbon cassette for transmitting the power of rotation of the motor to the ink ribbon moving mechanism to thereby move the ink ribbon when the cassette is mounted in position on the housing, said power transmitting means comprising a vertical rotator disposed on a lower inside surface of said housing, a hollow cylinder projecting upwards from the lower inside surface and coaxially slidably receiving the rotator, a flange coaxially horizontally fixed with the top end of the rotator, said flange having an outer periphery meshed with a gear connected to be rotationally driven by said motor, and a vertical shaft the lower end of which is coaxially releasably engaged with a central portion of the flange and the upper end of which is projected above said upper surface of said housing through a hole formed in said upper surface, said shaft being shaped to releasably engage with the ink ribbon moving mechanism to thereby move the ink ribbon;

holding means provided on the upper surface of the housing for removably holding one of the opposite edge portions of the upper surface of the ink ribbon cassette to thereby lock the cassette in position on the upper surface of the housing;

a guide pin fixedly provided on the upper surface of the housing for slidably guiding the ink ribbon drawn out of the ink ribbon cassette;

a guide roller inserted into and movable along an elongated slot formed in the upper surface of the housing for guiding the ink ribbon drawn out of the ink ribbon cassette while applying a tension to the ink ribbon in cooperation with the guide pin;

a rotatable ink pad provided on the upper surface of the housing to forcedly contact with the ink ribbon which is drawn out of the ink ribbon cassette, the ink ribbon being urged into contact with the ink pad by both the guide pin and the guide roller for distributing ink contained in the ink pad onto the ink ribbon; and a solenoid having a plunger actuated thereby and provided in the housing for releasably locking a shaft of the guide roller with the plunger at one of the opposite ends of the elongated slot.

2. A device according to claim 1; wherein said vertical shaft comprises a hollow cylinder capable of removably receiving therein and meshing with a finger-screw projecting from one of the opposite outer surfaces of the ink ribbon cassette for manually winding the ink ribbon in said cassette.

3. A device for regenerating an ink ribbon of an ink ribbon cassette, comprising:

a housing having an upper surface for mounting thereon an ink ribbon cassette having an ink ribbon and an ink ribbon moving mechanism operative when driven for moving the ink ribbon, the upper surface having a recessed portion having a plurality of elongate horizontal protrusions formed thereon, the protrusions being covered with an elastic material for frictionally mounting the ink ribbon cassette on the protrusions;

a motor disposed in the housing for producing a rotary output;

power transmitting means provided in the housing and connected to the motor and releasably engaged with the ink ribbon moving mechanism in the ink ribbon cassette for transmitting the power of rotation of the motor to the ink ribbon moving mechanism to thereby move the ink ribbon when the cassette is mounted in position on the housing;

holding means provided on the upper surface of the housing for removably holding one of the opposite edge portions of the upper surface of the ink ribbon cassette to thereby lock the cassette in position on the upper surface of the housing;

a guide pin fixedly provided on the upper surface of the housing for slidably guiding the ink ribbon drawn out of the ink ribbon cassette;

a guide roller inserted into and movable along an elongated slot formed in the upper surface of the housing for guiding the ink ribbon drawn out of the ink ribbon cassette while applying a tension to the ink ribbon in cooperation with the guide pin;

a rotatable ink pad provided on the upper surface of the housing to forcedly contact with the ink ribbon which is drawn out of the ink ribbon cassette, the ink ribbon being urged into contact with the ink pad by both the guide pin and the guide roller for distributing ink contained in the ink pad onto the ink ribbon; and a solenoid having a plunger actuated thereby and provided in the housing for releasably locking a shaft of the guide roller with the plunger at one of the opposite ends of the elongated slot.

4. A device according to claim 3; wherein said power transmitting means comprises a vertical rotator disposed on a lower inside surface of said housing, a hollow cylinder projecting upwards from the lower inside surface and coaxially slidably receiving the rotator, a flange coaxially horizontally fixed with the top end of the rotator, said flange having an outer periphery meshed with a gear connected to be rotationally driven by said motor, and a vertical shaft the lower end of which is coaxially releasably engaged with a central portion of the flange and the upper end of which is projected above the upper surface of said housing through a first hole formed in said upper surface, said shaft being shaped to releasably engage with the ink ribbon moving mechanism to thereby move the ink ribbon.

5. A device according to claim 4; wherein said vertical shaft comprises a hollow cylinder capable of removably receiving therein and meshing with a finger-screw projecting from one of the opposite outer surfaces of the ink ribbon cassette for manually winding the ink ribbon in said cassette.

6. A device according to claim 3; further comprising a spring connected at an end thereof with said guide roller for restoring said guide roller to the other one of the opposite ends of said elongated slot when said solenoid has been operated to release said guide roller from said end of said slot.

7. A device according to claim 3; further comprising at least one hollow formed in said upper surface of said housing for detachably receiving therein a projection formed on the outside of one of the upper and lower surfaces of the ink ribbon cassette to thereby mount said cassette in position on said elongate horizontal protrusions.

8. A device according to claim 3; wherein said holding means comprises a vertical rod rotatable around a vertical axis thereof and movable up and down through a second hole formed in said upper surface of said housing, said vertical rod having a top end provided with a horizontal protrusion for holding said ink ribbon cassette on said upper surface.

9. A device according to claim 8; wherein said rod of said holding means is removably inserted into and releasably engageable in said second hole.

10. A device according to claim 3; wherein said ink pad is composed of a porous material capable of absorbing ink to be distributed to the ink ribbon.

11. A device according to claim 10; wherein said ink pad has the shape of a column or the shape of a column the transverse section of which has a plurality of concave portions along the periphery of the section.

12. A device according to claim 10; wherein said porous material comprises one of a polyurethane foam and a polyvinylformal foam.

13. A device according to claim 3; wherein said plunger of said solenoid is retracted, when contacting with said shaft of said guide roller, to allow said guide roller to reach said end of said elongated slot and said plunger is projected to engage with said shaft to thereby lock said guide roller at said end of said slot.

14. A device according to claim 13; further comprising a timer for selectively setting a period of operation of said motor, and controlling means for controlling said solenoid to retract said plunger in cooperation with the timer so that said guide roller is released from its locked state at said end of said elongated slot when the ink contained in the ink pad has been distributed to the ink ribbon.

15. A device for regenerating an ink ribbon of an ink ribbon cassette, comprising:

a housing having an upper surface for mounting thereon an ink ribbon cassette;

driving means releasably engageable with an ink ribbon cassette mounted on the upper surface of the housing for winding an ink ribbon contained in the cassette, the driving means including a motor provided within the housing, a vertical rotator disposed on a lower inside surface of the housing, a hollow cylinder projecting upwards from the lower inside surface and coaxially slidably receiving the rotator, a flange coaxially horizontally fixed with the top end of the rotator and connected to be rotationally drive by the motor, and a vertical shaft the lower end of which is coaxially releasably engaged with a central portion of the flange and the upper end of which is projected above the upper surface of the housing through a hole formed in the upper surface, the shaft being shaped to releasably engage with a mechanism provided in the ink ribbon cassette for winding the ink ribbon contained in the cassette;

a rotatable ink pad mounted on the housing for applying ink to the ribbon; and guide means for guiding the ink ribbon drawn out of the ink ribbon cassette, the guide means including a guide member movable along an elongate path between a first position and a second position in which the ink ribbon is held by the guide means under tension in contact with the ink pad, the ink ribbon being deflected into engagement with the ink pad by movement of the guide member along said elongate path from a said first position in which the ink ribbon is not in contact with the ink pad to said second position.

16. A device according to claim 15; wherein the vertical shaft of the driving means comprises a hollow cylinder capable of removably receiving therein and meshing with a finger-screw projecting from one of the opposite outer surfaces of the ink ribbon cassette for manually winding the ink ribbon in the cassette.

17. A device for regenerating an ink ribbon of an ink ribbon cassette, comprising:

a housing having an upper surface for mounting thereon an ink ribbon cassette, the upper surface having a recessed portion having a plurality of elongate horizontal protrusions formed thereon, the protrusions being covered with an elastic material for frictionally mounting the ink ribbon cassette on the protrusions;

driving means releasably engageable with the ink ribbon cassette mounted on the elongate horizontal protrusions of the upper surface for winding an ink ribbon contained in the ink ribbon cassette;

a rotatable ink pad mounted on the upper surface of the housing for applying ink to the ink ribbon; and guide means for guiding the ink ribbon drawn out of the ink ribbon cassette, the guide means including a guide member movable along an elongate path between a first position and a second position in which the ink ribbon is held by the guide means under tension in contact with the ink pad, the ink ribbon being deflected into engagement with the ink pad by movement of the guide member along said elongate path from said first position in which the ink ribbon is not in contact with the ink pad to said second position.

18. A device according to claim 17; wherein the driving means includes a motor provided within the housing, a vertical rotator disposed on a lower inside surface of the housing, a hollow cylinder projecting upwards from the lower inside surface and coaxially slidably receiving the rotator, a flange coaxially horizontally fixed with the top end of the rotator and connected to be rotationally driven by the motor, and a vertical shaft the lower end of which is coaxially releasably engaged with a central portion of the flange and the upper end of which is projected above the upper surface of the housing through a hole formed in the upper surface, the shaft being shaped to releasably engage with a mechanism provided in the ink ribbon cassette for winding the ink ribbon contained in the cassette.

19. A device according to claim 18; wherein the vertical shaft of the driving means comprises a hollow cylinder capable of removably receiving therein and meshing with a finger-screw projecting from one of the opposite outer surfaces of the ink ribbon cassette for manually winding the ink ribbon in the cassette.

* * * * *